US005918495A

United States Patent [19]

Miyamoto et al.

[11] Patent Number: 5,918,495

[45] **Date of Patent: *Jul. 6, 1999**

[54] MULTISTAGE GEAR-ROLLING APPARATUS

[75] Inventors: Noritaka Miyamoto; Masazumi Onishi, both of Toyota; Yasuyuki Fujiwara, Aichi-ken; Toshiaki Tanaka, Nagoya; Shintaro Igarashi, Toyota; Atsushi Danno, Nagoya; Kenichi Yamaguchi; Shinichi Nagamori, both of Toyama, all of Japan

[73] Assignees: Toyota Jidosh Kabushiki Kaisha, Toyota; Nachi-Fujikoshi Corporation, Toyama, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/703,014

[22] Filed: Aug. 26, 1996

[30] Foreign Application Priority Data

Sep. 6, 1995 [JP] Japan ..... 7-229305

[51] Int. Cl.[6] ..... B21H 5/00

[52] U.S. Cl. ..... 72/108; 72/110

[58] Field of Search ..... 72/98, 102, 107, 72/108, 109, 110, 111, 104

[56] References Cited

U.S. PATENT DOCUMENTS

| | | | |
|---|---|---|---|
| 1,001,799 | 8/1911 | Anderson | 72/102 |
| 1,665,286 | 4/1928 | Stroh et al. | 72/108 |
| 3,894,418 | 7/1975 | Horl | 72/108 |
| 4,116,032 | 9/1978 | Krapfenbauer et al. | 72/68 |
| 5,301,528 | 4/1994 | Hofmann et al. | 72/108 |
| 5,339,669 | 8/1994 | Cretin et al. | 72/108 |

FOREIGN PATENT DOCUMENTS

| | | | |
|---|---|---|---|
| A-2-175-136 | 10/1973 | France . | |
| 53-17550 | 2/1978 | Japan . | |
| A-54-62148 | 5/1979 | Japan . | |
| 54-99055 | 8/1979 | Japan . | |
| 61-222648 | 10/1986 | Japan . | |
| A-1-810-196 | 8/1994 | Russian Federation . | |
| 1225659 | 4/1986 | U.S.S.R. | 72/108 |
| 1255252 | 9/1986 | U.S.S.R. | 72/102 |
| A-1-225-659 | 12/1986 | U.S.S.R. . | |
| A-1-400-743 | 2/1989 | U.S.S.R. . | |

*Primary Examiner*—Lowell A. Larson
*Attorney, Agent, or Firm*—Oliff & Berridge, PLC

[57] ABSTRACT

A multistage gear-rolling apparatus of the present invention comprises a roller squeezing apparatus including a roughing roller die and a finishing roller die disposed coaxially and connected in series in an axial direction of said roughing roller die. The roughing roller die is used for carrying out a hot rough-rolling step. The finishing roller die is used for a warm finish-rolling step. Thus, immediately after the hot rough-rolling step, the warm finish-rolling step can be carried out without a reset of workpiece.

12 Claims, 8 Drawing Sheets

Fig. 7
Fig. 7(A)
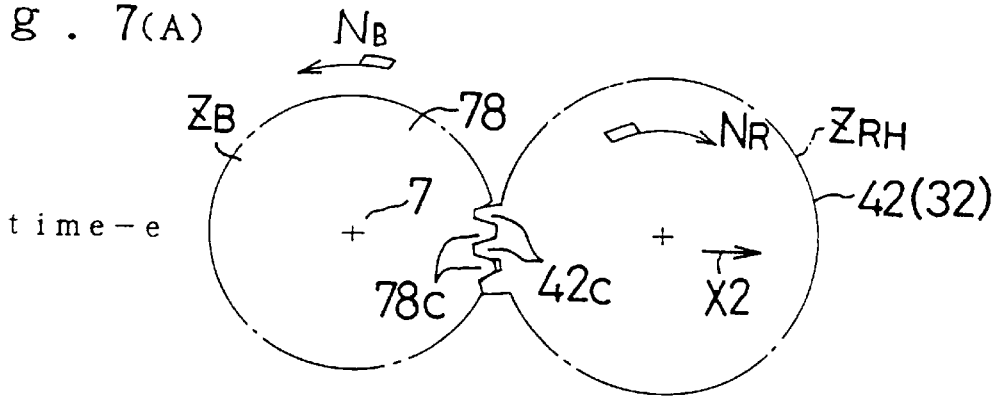
Fig. 7(B)
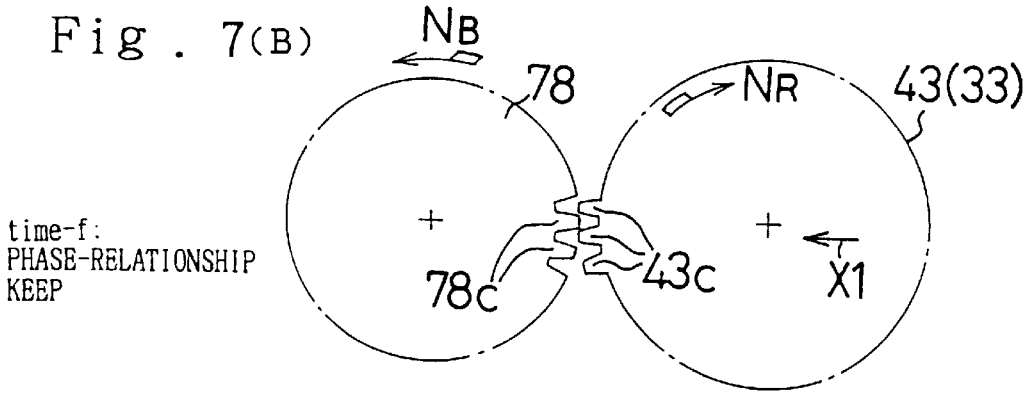
Fig. 7(C)
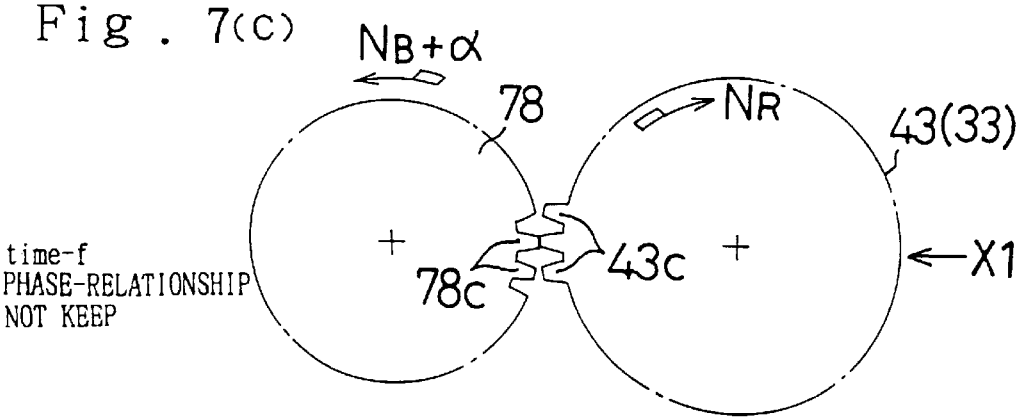

PRIOR ART

MULTISTAGE GEAR-ROLLING APPARATUS

BACKGROUND OF THE INVENTION

1. Field of the Invention

The present invention relates to a multistage gear-rolling apparatus. For instance, it is applicable to production of vehicle-flywheels having teeth and gears used in driving systems.

2. Description of the Related Art

Generally, gears have been produced by way of a hob-cutting step and a shaving finish-step with respect to a disk-shaped workpiece. In this technique, when an outer diameter and a facewidth of the gear are increased, producing efficiency is reduced and production costs are increased.

Accordingly, there has been developed a gear-rolling technique for generating gear-teeth by use of a rolling step. In accordance with this technique, since a rolling step in high temperatures is carried out, the teeth can be generated in an outer-circumferential portion of a workpiece. This rolling method is advantageous in decreasing costs in comparison with the method using the aforementioned hob-cutting step and shaving finish-step.

As for this gear-rolling method apparatus, a finishing rolling method apparatus has been disclosed in Japanese Unexamined Patent Publication (KOKAI) No.54-62,148. In this apparatus, as can be seen in FIG. 11, a set of rollers 203, having the first forming teeth 201 and the second forming teeth 202 disposed coaxially and longitudinally in series, are used. The first forming teeth 201 of the roller 203 are used for finish-rolling a first teeth portion 101 of a workpiece 100, and the second forming teeth 202 of the roller 203 are used for finish-rolling a second teeth portion 102 of the workpiece 100.

According to this conventional gear-rolling technique, after the workpiece 100 is set at a regular location, the first forming teeth 201 of the roller 203 are squeezed in the direction of the arrow "A1", and thereby the first teeth portion 101 are finish-rolled. Thereafter, the first forming teeth 201 are withdrawn in the direction of the arrow "A2".

Next, the workpiece 100 is relatively moved in the direction of the arrow "B1", that is, the axial direction. After that, the second forming teeth 202 of the roller 203 are squeezed in the direction of the arrow "A1", and thereby the second teeth portion 102 are finish-rolled.

Now, according to the gear-rolling technique disclosed in the above-mentioned publication, the rollers 203 are used not for rough-rolling but simply for finish-rolling. Therefore, this publication gear-rolling technique requires that the workpiece 100 formed by the rough-rolling apparatus is once removed from the rough-rolling apparatus and the workpiece 100 is reset to the finish-rolling apparatus having the roller 203 after the removal. Accordingly, there might arise fears in that an axial aberration of the workpiece 100 because of resetting the workpiece 100, roundness of the rolled gear is easy to be deteriorated; thus, the above-mentioned publication gear-rolling technique is disadvantageous in improving accuracy of the rolled gear because of resetting the workpiece 100.

Further, according to the above-mentioned publication technique, although the first forming teeth 201 and the second forming teeth 202 are disposed coaxially and in series in the axial direction, the first forming teeth 201 are used only for finish-rolling the first teeth 101 of the workpiece 100, similarly, the second forming teeth 202 are used only for finish-rolling the second teeth 102.

Moreover, according to the above-mentioned publication technique, when the first forming teeth 201 of the roller 203 begin engaging with the first teeth portion 101 of the workpiece 100 for the finish-rolling, this publication technique requires that an engaging special mechanism for engaging with the both smoothly. Similarly, when the second forming teeth 202 of the roller 203 begin engaging with the second teeth portion 102 of the workpiece 100 for the finish-rolling, this publication technique requires that an engaging special mechanism for engaging with the both smoothly.

SUMMARY OF THE INVENTION

The present invention has been developed in view of the aforementioned circumstances. It is therefore a first object of the prime aspect of the present invention to provide a multistage gear-rolling apparatus which can carry out a finish-rolling step immediately after a rough-rolling step to be capable of abolishing a reset of workpiece so that axial aberration of a workpiece is advantageously reduced or avoided and which can contribute to improvement in accuracy of a rolled gear.

It is therefore an object of the second aspect of the present invention to provide a multistage gear-rolling apparatus which can carry out a warm finish-rolling step immediately after a hot rough-rolling step without a reset of workpiece so that a starting temperature range and a terminating temperature range are kept suitably and which can carry out a warm finish-rolling step dexterously to contribute to improvement in accuracy of a rolled gear.

It is therefore an object of the third aspect of the present invention to provide a multistage gear-rolling apparatus which can achieve an engagement between a rough-rolled gear and a finishing roller die to reduce or to omit a phase adjusting operation and which can carry out a finish-forming of teeth of a rolled gear dexterously to contribute to improvement of accuracy in a rolled gear.

In a first aspect of the present invention, a multistage gear-rolling apparatus comprises:

a roller squeezing apparatus including at least a roughing roller die and a finishing roller die disposed coaxially and connected in series in an axial direction of the roughing roller die, the roughing roller die having a lot of forming teeth arranged in a circumferential direction for a rough-rolling step, the finishing roller die having a lot of forming teeth arranged in a circumferential direction for a finish-rolling step.

In a second aspect of the present invention, the roughing roller die is used for carrying out a hot rough-rolling step, and the finishing roller die is used for a warm finish-rolling step.

In a third aspect of the present invention, a multistage gear-rolling apparatus comprises:

a workpiece holding portion for holding a workpiece to be transformed into a rolled gear;

a roller squeezing apparatus capable of squeezing the workpiece and withdrawing from the workpiece, the roller squeezing apparatus including at least a roughing roller die and a finishing roller die disposed coaxially and connected in series in an axial direction of the roughing roller die, the roughing roller die having a lot of forming teeth arranged in a circumferential direction for a rough-rolling step, the finishing roller die having a lot of forming teeth arranged in a circumferential direction for a finish-rolling step;

means for adjusting a phase of the forming teeth of the roughing rolling die and a phase of the forming teeth of the finishing roller die to each other in a circumferential direction; and means for controlling the engagement between the forming teeth of the finishing roller die and the teeth of the rough-rolled gear in a circumferential direction, the engagement controlling means targets the keeping of a circumferential phase-relationship between the teeth of the rough rolled gear formed by the roughing roller die and the forming teeth of the roughing roller, the engagement controlling means rotates the roughing roller die, the finishing roller die and the workpiece held on the workpiece holding portion, squeezes the roller squeezing apparatus to the rough-rolled gear with the phase-relationship just after the rough-rolling step being kept, and thereby the forming teeth of the finishing roller die are smoothly engaged with the teeth of the rough-rolled gear.

In the first aspect of the present invention, the finish-rolling step can be carried out immediately after the rough-rolling step. Therefore, the workpiece can be finish-rolled without the reset of workpiece; thus, the axial aberration due to the reset of workpiece is reduced or avoided. Accordingly, roundness of the rolled gear is enhanced, and accurate gears are advantageously produced.

In the second aspect of the present invention, the warm finish-rolling step can be carried out immediately after the hot rough-rolling step. Therefore, the workpiece is finish-rolled without the reset of workpiece; thus, the axial aberration due to the reset of workpiece is reduced or avoided, roundness of the rolled gear is enhanced, and thereby accurate gears are advantageously produced.

Moreover, in the second aspect of the present invention, since the warm finish-rolling step can be carried out immediately after the hot rough-rolling step, a starting temperature range and a terminating temperature range of the warm finish-rolling step are kept suitably, so that the warm finish-rolling step is carried out dexterously. Hence, rectifying effect with respect to the rolled-gear in the finish-rolling step is ensured, and thereby accurate gears are advantageously produced.

Also, in the third aspect of the present invention, when the finish-rolling step starts, the forming teeth of the finishing roller die can be smoothly engaged with the the teeth of the rough-rolled gear because of the engagement controlling means. As a result, not only that an excessive collision between the finishing roller die and rough-rolled gear is reduced or avoided, but also that the finish-rolling step is dexterously carried out from the starting thereof, thereby accurate gears are advantageously produced.

In the present invention, another roller die, which is used for carrying out other treatments such as chamfering, marking, can preferably be disposed with the roughing roller die and the finishing roller die coaxially and in series in an axial direction of the roughing roller die.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIGS. 7(A), 7(B) and 7(C) are a constructive view which illustrate operation of the apparatus of the First Preferred Embodiment;

DETAILED DESCRIPTION OF THE PREFERRED EMBODIMENT

A Preferred Embodiment of a multistage gear-rolling apparatus according to the present invention will be hereinafter described with reference to the accompanied drawings.

(Apparatus Construction in this Embodiment)

Figure 1:
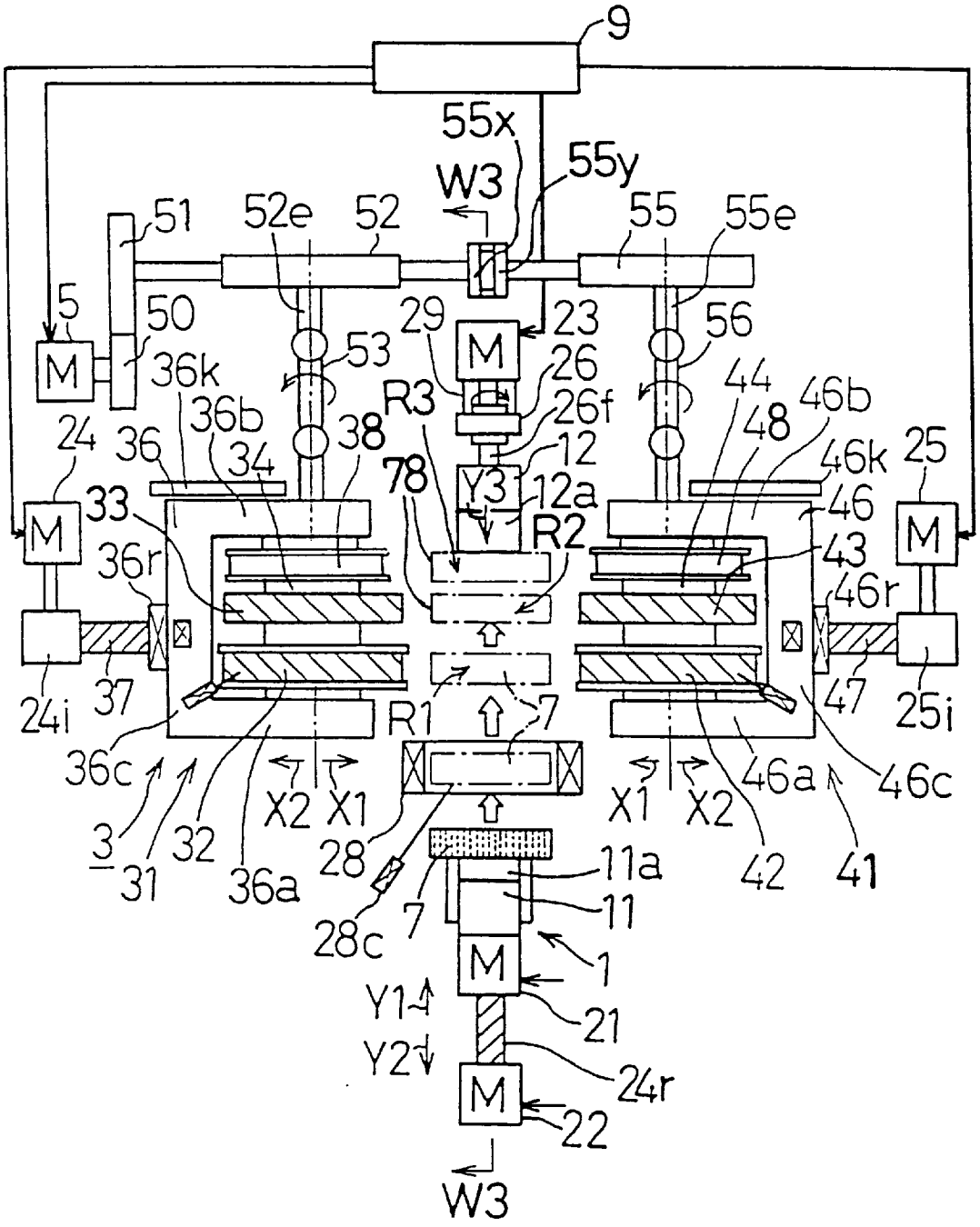
FIG. 1 is a plan view which schematically illustrates a whole apparatus of a First Preferred Embodiment according to the present invention.
Figure 2:
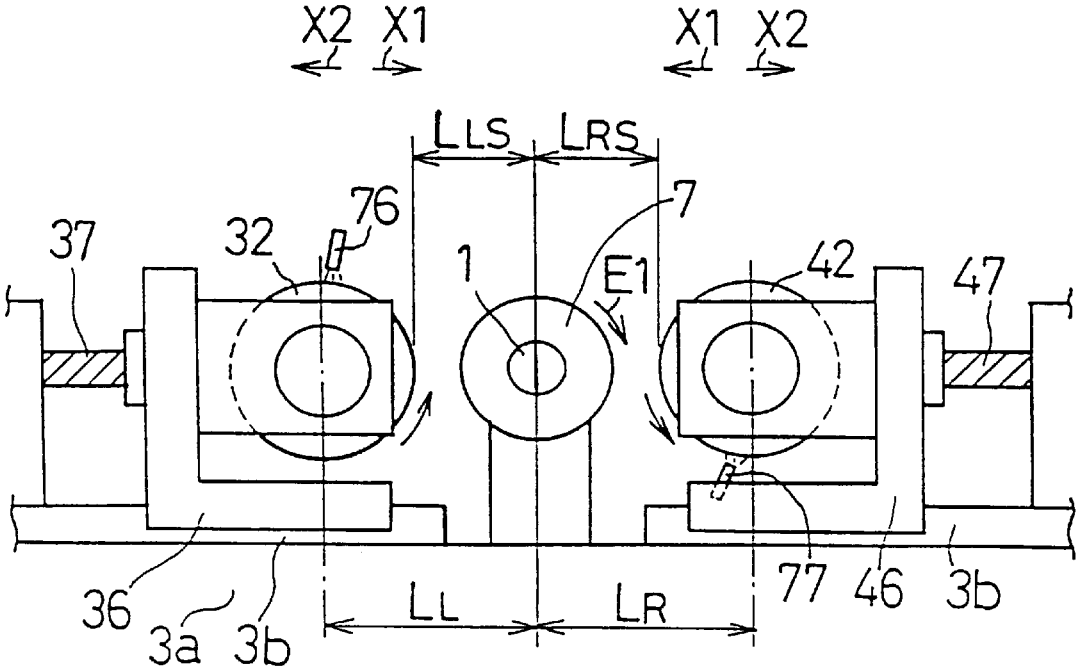
FIG. 2 is a front view which illustrates a major portion of the apparatus of the First Preferred Embodiment according to the present invention.
Figure 3:
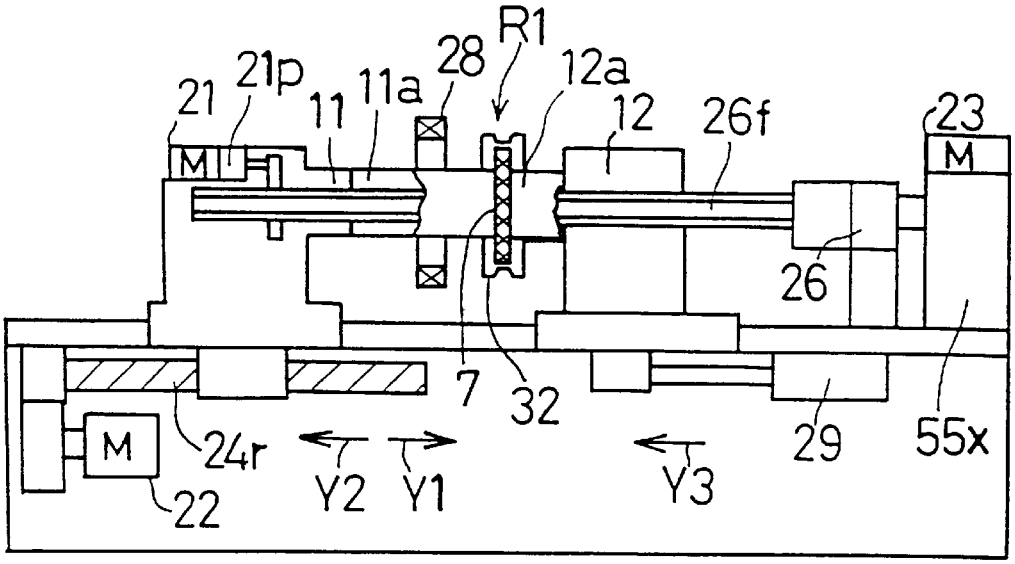
FIG. 3 is a cross-sectional view of the apparatus taken along the arrow "W3—W3" of FIG. 1.

The apparatus will be hereinafter described with reference to FIG. 1. FIG. 1 is illustrates the plan view of the whole apparatus. FIG. 2 illustrates the front view of the major portion of the apparatus. FIG. 3 is the cross-sectional view of the apparatus taken along the arrow "W3—W3" of FIG. 1.

As can be seen from FIG. 1, a blank holding portion 1, which operates as a workpiece holding portion, comprises a first blank holding portion 11 and a second blank holding portion 12 facing to each other. The first blank holding portion 11 includes a first blank holding shaft 11*a* having a large-diameter, and the second blank holding portion 12 includes a second holding shaft 12*a* having a large-diameter.

A first motor 21 operates as a blank rotating means for operating the blank, that is, the workpiece. When the first motor 21 drives, the first blank holding portion 11 rotates in a circumferential direction thereof (i.e., the direction of the arrow "E1" in FIG. 2).

In FIG. 1, there is disposed a second motor 22 for moving the first blank holding portion 11 to transfer the blank. When the second motor 22 drives, a ball screw shaft 24*r* rotates in a circumferential direction thereof, and thereby the first blank holding portion 11 and the blank 7 are transferred in directions of arrow "Y1" "Y2".

In FIG. 1, when a third motor 23 which operates as a blank rotating means drives, the second blank holding portion 12 rotates by way of a torque transmitting variable clutch 26 (for instance, a powder clutch) in a circumferential direction thereof, namely, the same direction as the rotating direction of first blank holding portion 11. When a hydraulic cylinder 29 for transferring the second blank holding portion 12 drives, the second blank holding portion 12 is transferred toward the first blank holding portion 11 in the direction of the arrow "Y3" by use of the ball-splined shaft 26*f*, and thereby the second blank holding portion 12 and the first blank holding portion 11 can hold the blank 7 forcibly.

In FIG. 1, on the other side of the first blank holding portion 11, there is disposed a high-frequency heating coil 28 which operates as a ring-shaped heating means for heating the blank 7 by means of induction-heating. A thermal sensor 28*c*, that is, a radiation pyrometer, detects situations of the heated blank.

A roller squeezing apparatus 3 includes a first roller squeezing apparatus 31 and a second roller squeezing apparatus constituting a pair for holding the blank 7 in the radius 11 direction of the blank 7. The first roller squeezing apparatus 31 comprises a first roughing roller die 32 for working as a hot rolling tool, a first finishing roller die 33 for working as a warm rolling tool, a roller die 38 for adding another treatment, such as marking or chamfering, to the blank 7, a first connecting shaft 34, and a first housing 36. The first connecting shaft 34 connects the first roughing roller die 32, the first finishing roller die 33, and the roller die 38 in series along the axial direction and coaxitially. The first roughing roller die 32, the first finishing roller die 33, and the roller die 38 are rotatably held on the first housing 36. Further, the first roller squeezing apparatus 31 includes a fourth motor 24 and a first ball screw shaft 37.

As can be seen from FIG. 1, similarly, the second roller squeezing apparatus 41 comprises a second roughing roller die 42 for working as a hot rolling tool, a second finishing roller die 43 for working as a warm rolling tool, a roller die 48 for adding another treatment, such as marking or chamfering, to the blank 7, a second connecting shaft 44, and a second housing 46.

The second connecting shaft 44 connects the second roughing roller die 42, the second finishing roller die 43, and the roller die 48 in series in the axial direction and coaxitially. The second roughing roller die 42, the second finishing roller die 43, and the roller die 48 are rotatably held on the second housing. 46. Further, the second roller squeezing apparatus 41 includes a fifth motor 25 and a second ball screw shaft 47.

The first housing 36 is capable of squeezing the blank 7 in the direction of the arrow "X1" and is capable of withdrawing from the blank 7 in the direction of the arrow "X2". The second housing 46 is capable of squeezing the blank 7 in the direction of the arrow "X1" and is capable of withdrawing from the blank 7 in the directions of the arrow "X2".

As can be understood from FIG. 1, the first housing 36 having a "channel-shape" in a plan view, includes two first faced thick-wall portions 36*a*,36*b* ; facing each other, and a first connecting thick-wall portion 36*c* for connecting the first faced thick-wall portions 36*a*, 36*b*. Also, the second housing 46, having a "channel-shape" in a plan view, includes two second faced thick-wall portions 46*a*,46*b* facing each other, and a second connecting thick-wall portion 46*c* for connecting the second faced thick-wall portions 46*a*, 46*b*.

As can be understood from FIG. 2, the first housing 36 and the second housing 46 are movable along the guiding portions 3*b* fixed on the base 3*a* for supporting themselves in the directions of the arrow "X1" "X2".

Turning back to FIG. 1, the fourth motor 24 is driven, the driving force of the fourth motor 24 is reduced by use of the first speed reducer 24*i* and is transmitted to the first ball screw shaft 37. Then, the first ball screw shaft 37 is rotated in the circumferential direction, the first housing 36 is transferred in the direction of the arrow "X1"; hence, the first roughing roller die 32, the first finishing roller die 33 and the roller die 38 which are held on the first housing 36 are transferred in the same direction.

Also, when the fourth motor 24 is conversely rotated, the first ball screw shaft 37 is conversely rotated in the circumferential direction thereof, and thereby the first housing 36 is transferred in the direction of the arrow "X2". Accordingly, the first roughing roller die 32, the first finishing roller die 33 and the roller die 38 are transferred together in the same direction to be withdrawn from the blank 7. Hence, the fourth motor 24 and the first ball screw shaft 37 operate as squeezing means for squeezing the first roughing roller die 32, the first finishing roller die 33 and the like toward the blank 7.

Similarly, in FIG. 1, when the fifth motor 25 is driven, the driving force of the fifth motor 25 is reduced by use of the second speed reducer 25*i* and is transmitted to the second ball screw shaft 47. Then, the second ball screw shaft 47 is rotated in the circumferential direction thereof, the second housing 46 is transferred in the direction of the arrow "X1"; hence, the second roughing roller die 42 and the second finishing roller die 43 are transferred in the same direction.

When the fifth motor 25 is conversely rotated, the second ball screw shaft 47 is conversely rotated in the circumferential direction, and thereby the second housing 46 is transferred in the direction of the arrow "X2". Accordingly, the second roughing roller die 42, the second finishing roller die 43 and roller die 48 are transferred together in the same direction to be withdrawn from the blank 7. Hence, the fifth motor 25 and the second ball screw shaft 47 operate as squeezing means for squeezing the second roughing roller die 42, the second finishing roller die 43 and the like toward the blank 7.

The load working on the first housing 36 is detected by use of a first load cell. 36*r*, and a transferred amount of the first housing 36 is detected by use of a first liner scale 36*k*. The load working on the second housing 46 is detected by use of a second load cell 46*r*, and a transferred amount of the second housing 46 is detected by use of a second liner scale 46*k*. Each of detected signals is inputted to a controller system 9. The aforementioned fourth motor 24 and fifth motor 25, constituting a servo-motor respectively, are controlled on the basis of squeezing synchronous command signals and withdrawing synchronous command signals, and thereby operating the first ball screw shaft 37 and the second ball screw shaft 47 synchronously. Accordingly, the first roughing roller die 32 and the second roughing roller die 42 can be synchronously squeezed in the direction of the arrow "X1" and can be synchronously withdrawn in the direction of the arrow "X2".

Also, in FIG. 1, when the motor 5 constituting the servo-motor for rotating the dies is driven on the basis of driving command signals, the first reducer 52 is worked by way of gears 50,51 for reducing speed. Then, the first connecting shaft 34, the first roughing roller die 32, the first finishing roller die 33, and roller die 38 are rotated together by way of the rotating shaft 52*e* and the first constant speed universal joint 53.

Moreover, the driving force of the motor 5 for rotating the first die is transmitted to a phase adjusting mechanism 55*x*, a second reducer 55, a rotating shaft 55*e*, and a second constant speed universal joint 56. Accordingly, the driving force of the motor 5 is transmitted to the second connecting shaft 44, the second roughing roller die 42, the second finishing roller die 43, and the roller die 48; therefore, they are rotated.

The phase adjusting mechanism 55*x* is used for adjusting the circumferential phase of the forming teeth of the first roughing roller die 32 to the circumferential phase of the forming teeth of the second roughing roller die 42. The phase adjusting mechanism 55*x* has a function for canceling the phase-difference between the first roughing roller die 32 and the second roughing roller die 42. With the object of realizing this function, two disks 55*x*,55*y* are fixed on condition of capable of shifting their position relatively in the circumferential thereof.

Figure 4:
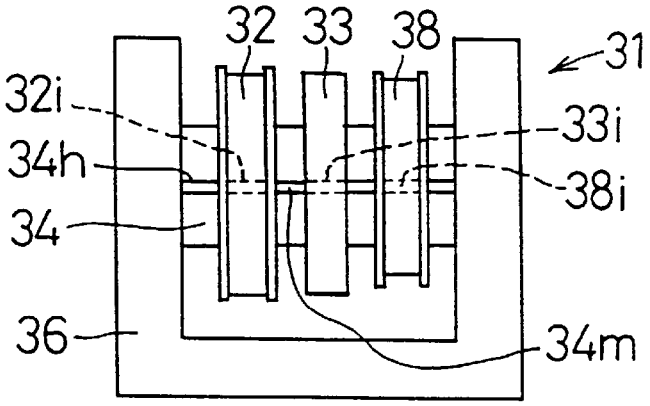
FIG. 4 is a constructive view which illustrates a first roller squeezing apparatus.

Now, FIG. 4 shows the first roller squeezing apparatus. As can be seen from FIG. 4, in the first roller squeezing apparatus 31, a keyway 34*h* is formed at the first connecting shaft 34, rotatablely held on the first housing 36, along the axial direction. Further, a mating keyway 32*i* is formed at the inner circumferential portion of the fitting hole of the first roughing roller die 32, a mating keyway 33*i* is formed at the inner circumferential portion of the fitting hole of the first finishing roller die 33, and a mating keyway 38*i* is formed at the inner circumferential portion of the fitting hole of the roller die 38. A key 34*m* is engaged with the mating keyways 32*i*, 33*i*, 38*i* and a keyway 34*h* formed at the first connecting shaft 34, thereby the three dies 32, 33, 38 are integrated with respect to the circumferential direction.

Figure 5:
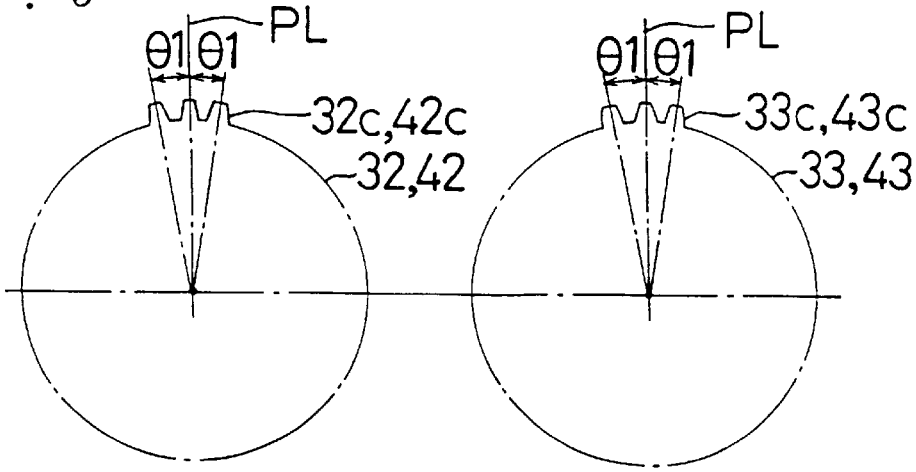
FIG. 5 is a constructive view which illustrates a phase-relationship between teeth of a roughing roller die and teeth of a finishing roller die.

Accordingly, as can be understood from FIG. 5, when the center of one of the forming teeth 32*c* in the roughing roller die 32 is adjusted to the plumb-line "PL", the others of forming teeth 32*c* are disposed at intervals of θ1 angle degrees. Also, when the center of one of the forming-teeth 33*c* of the finishing roller die 33 is adjusted to the plumb-line "PL", the others of the forming teeth 33*c* are disposed at intervals of θ1 angle degrees. In other words, the circumferential phase of the forming teeth 32*c* of the roughing roller die 32 agrees with the circumferential phase of the forming teeth 33*c* of the finishing roller die 33. Therefore, the aforementioned key and keyways operate as the forming teeth phase adjusting means. The total number of the teeth in the finishing roller die 33 is as many as those of the roughing roller dies 32. The total number of the teeth in the finishing roller die 43 is as many as those of the roughing roller die 42. Here, FIG. 5 shows only part of the forming teeth 32*c*, 33*c*.

The second roller squeezing apparatus 41 has the similar construction to the first roller squeezing apparatus 31; therefore, as can be understood from FIG. 5, the aforementioned key and keyways adjust the circumferential phase of the forming die 42*c* of the second roughing roller die 42 to the circumferential phase of the forming teeth 43*c* of the second finishing roller die 43.

Moreover, in this embodiment, as can be understood from FIG. 2, a first emitting device 76 for emitting liquid-lubricant is equipped to face the portion passed a rolling area in the first roughing roller die 32. Also, a second emitting device 77 for emitting liquid-lubricant containing graphite powder is equipped to face the portion passed a rolling area in the second roughing roller die 42. Namely, the first emitting device 76 and the second emitting device 77 are respectively separately disposed at the position being an angle of 90° apart.

(Rolling Process in Embodiment)

In FIG. 1, the carbon steel based blank 7 (material; JIS-STANDARD S58C), being kept in the normal temperature range, is held on the first blank holding portion 11. Next, the second motor 22 is driven to transfer the blank 7 in the direction of the arrow "Y1" and to dispose the blank 7 in the high-frequency heating coil 28. In this circumstances, the motor 21 is driven to rotate the blank 7 in the circumferential direction (i.e., the direction of the arrow "E1" in FIG. 2). While the blank 7 is rotated, the outer circumferential portion of the blank 7 is induction-heated by use of the high-frequency heating coil 28. The range heated up to 900° C. in the blank 7 is from the outer circumferential of the blank 7 to a depth being approximately 1.3 times of the tooth height. The heating time is set in the neighborhood from some seconds through 30 seconds.

As soon as the blank 7 is heated to the designated temperature range, the rolling step is carried out. The time from the termination of the heating step to the start of the hot roughing-rolling step is set within 5 seconds. The reason is that the heat-transmission into the inside of the blank 7 is suppressed to reduce the increasing of the temperature in the middle portion of the blank 7 for improving a temperature-distribution in the blank 7.

For the rolling step, as the ball screw shaft 24*r* is operated by use of the second motor 22, the blank 7 is transferred in the direction of the arrow "Y1" to be disposed at a forming location "R1" in FIG. 1. At this time, the second blank holding portion 12 is moved in the direction of the arrow "Y3"; thus, both of the second blank holding portion 12 and the first blank holding portion 11 hold the blank 7 forcibly as illustrated in FIG. 3. The forcible force is secured to several [tonf] by use of the hydraulic cylinder 29 shown in FIG. 3.

In this circumstances, the blank 7 is rotated in the circumferential direction thereof on the basis of the driving force of the third motor 23. At this time, a clutch 21*p* shown in FIG. 3 is turned off in order not to transmit the driving force of the first motor 21 to the blank 7.

Moreover, the first roughing roller die 32 and the second roughing roller die 42 are rotated at a predetermined constant speed in the range of from 150 through 300 [rpm]. On the basis of the squeezing synchronous command signals outputted from the controller system 9, the first roughing roller die 32 and the second roughing roller die 42 are synchronously squeezed to the outer circumferential portion of the blank 7 in the direction of the arrow "X1" (squeezing speed: 6 mm/sec). After the squeezing operation, keeping the operation is carried out for approximately 4 seconds at the squeezed end.

Accordingly, the deformation constituting the teeth portion and the sizing are carried out at the outer circumferential portion of the blank 7, so that the plural teeth are generated during the rolling step and the rolled gear 78 can be produced. After that, on the basis of the withdrawing synchronous command signals outputted from the controller system 9, the first roughing roller die 32 and the second roughing roller die 42 are synchronously withdrawn from the outer circumferential portion of the blank 7 in the direction of the arrow "X2".

In this embodiment, the squeezing synchronous precision between the first roughing roller die 32 and the second roughing roller die 42 is high. As can be seen in FIG. 2, the distance between the central axis line of the blank 7 and the central axis line of the first roughing roller die 32 is indicated as $L_L$, and the distance between the central axis line of the blank 7 and the central axis line of the second roughing roller die 42 is indicated as $L_R$. Here, $L_L$ and $L_R$ correspond with each other within the precision higher than the range from 0.03 through 0.05 mm. Thus, a lean of the teeth-groove in the rolled gear can be decreased.

In this embodiment, as for the hot rough-rolling step, the starting temperature can be set in the range of from 850 through 1100° C., the terminating temperature can be set in the range of from 500 through 700° C.

After the hot rough-rolling step is terminated as described above, the cylinder 29 shown in FIG. 3 and the second motor 22 transfer the blank 7 further in the direction of the arrow "Y1" to dispose the blank 7 at the finish-forming location "R2" shown in FIG. 1. In this circumstances, on the basis of the squeezing synchronous command signals outputted from the controller system 9, the first finishing roller die 33, being rotated with the first roughing roller die 32, is transferred in the direction of the arrow "X1" to be squeezed toward the blank 7, and the second finishing roller die 43, being rotated with the second roughing roller die 42, is transferred in the direction of the arrow "X1" to be squeezed to the blank 7 synchronously. Therefore, the teeth of the blank 7 are finish-rolled in the range of warm temperatures. After that, the first finishing roller die 33 and the second finishing roller die 43 are transferred in the direction of the arrow "X2" and are withdrawn from the blank 7.

In this embodiment, as for the warm finish-rolling step, the starting temperature can be set in the range of from 400 through 700° C., the terminating temperature can be set in the range of from 200 through 650° C.

The warm finish-rolling step is terminated as described above. Next, the rolled gear 78 is transferred to the location "R3". In this circumstances, since the roller dies 38,48 are squeezed in the direction of the arrow "X1", a chamfering treatment or a marking treatment is carried out with respect to the rolled gear 78.

(Timing Chart)

Figure 6:
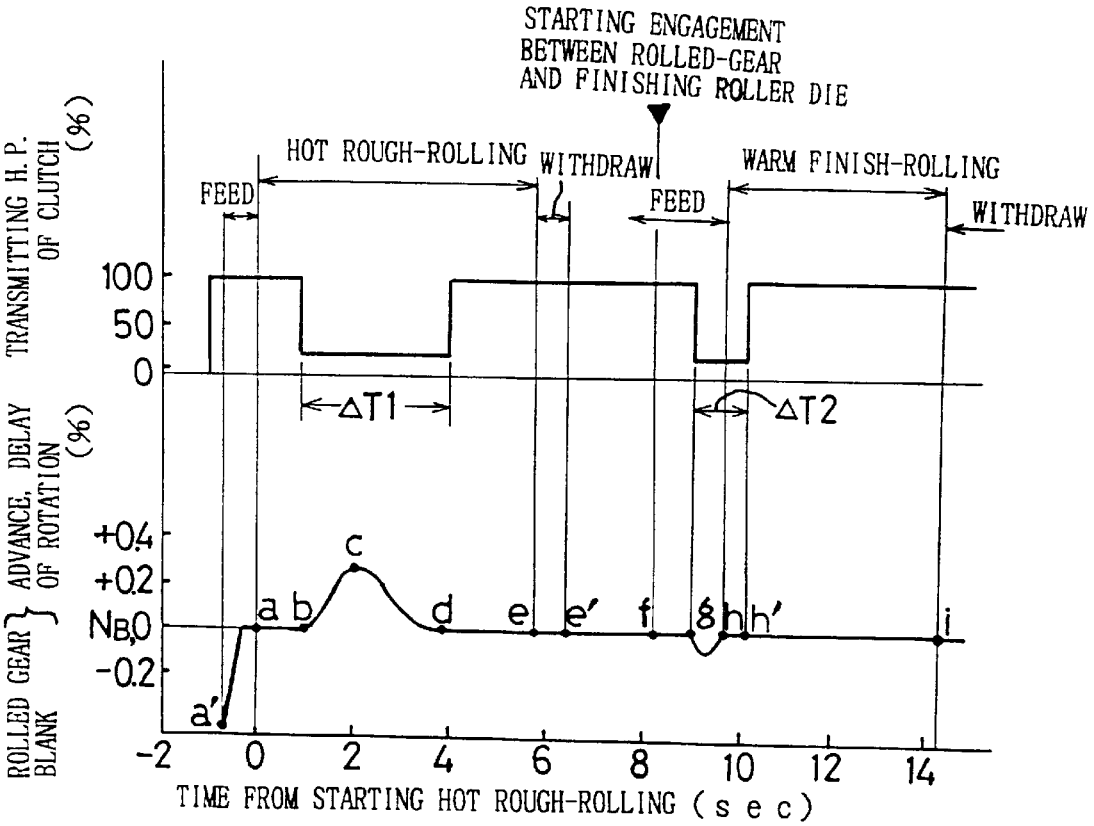
FIG. 6 is a timing chart which illustrates a progress from the starting of a hot rough-rolling step.

FIG. 6 shows an example of timing charts where the rolling step carried out by use of the embodiment apparatus. The horizontal axis in FIG. 6 shows the passed time when the starting time for the hot rough-rolling step is set at "0". The lower part of vertical axis in FIG. 6 shows advance and delay in the blank-rotation when a target rotational speed of the aforementioned blank 7 is set at $N_B$. The upper part of the vertical axis shows a ratio of horsepower(h.p.) in the torque transmitting variable clutch 26. This ratio means the ratio at which the driving force of the third motor 23 is transmitted to the second holding shaft 12*a* of the second blank holding portion 12.

From time-a' in FIG. 6, the roughing roller dies 32, 42 are begun to be fed in the squeezing direction. From time-a, being immediately after time-a', through time-e, the hot rough-rolling step is carried out with respect to the blank 7. From time-e, the roughing roller dies 32,42 are withdrawn from the rolled gear 78 in the direction of the arrow "X2". From immediately after time-e', the finishing roller dies 33, 43 are begun to be fed in the squeezing direction (i.e., the direction of the arrow "X1"). At time-f, the forming teeth 33*c*,43*c* of the finishing roller dies 33,43 begin to engage with the teeth of rough-rolled gear 78.

In this embodiment, a target rotational speed $N_B$ is set as follows: In FIG. 7, the rotational speed of the roughing roller dies 42(32) is indicated as $N_R$, the number of the teeth in the roughing roller dies 42(32) is indicated as $Z_{RH}$, the number of the teeth in the rolled gear 78 made from blank 7 is indicated as $Z_B$, $$N_B = NR \times [Z_{RH}/Z_B]$$

Here, the number of the teeth of finishing roller dies 33, 43 is set at that of the roughing rolled dies 32, 42, namely, $Z_{RH}$.

As can be seen from FIG. 6, the blank 7 is basically rotated at the target rotational speed $N_B$ except specified periods. Thus, the controller system 9, which operates as an engagement controlling means, controls the second holding shaft 12*a* of the second blank holding portion 12 in order to control the blank 7 without advance and delay with respect to the target rotational speed $N_B$. Also, the roller dies 32, 42, 33, 43 is controlled on the basis of the controller system 9 to rotate at a rotational speed "$N_R$.

However, as shown from time-b to time-c in FIG. 6, the rotational speed of the blank 7 is gradually increased with the hot rough-rolling step progressing. For example, the rotational speed of the blank 7 is increased by +0.3% with respect to the target rotational speed $N_B$. This reason will be described hereinafter: The engagement between the teeth of the rolled gear 78 and the forming teeth 32*c*,42*c* of the roughing roller dies 32,42 is enhanced with the teeth of the rolled gear 78 generated, so that the rotational speed of the rolled gear 78 is increased under the influence of the rotational driving force of the roughing roller dies 32,42.

Accordingly, as shown as ΔT1 in FIG. 6, the controller system 9 controls the transmitting torque variable clutch 26 from time-b through time-d to decrease the rate of the transmitted horsepower in the range of less than 50% and to decrease the transmitting of the driving force from the third motor 23. Thus, the rotational speed of the blank 7(i.e., the rolled gear 78) returns again to the target rotational speed $N_B$. Therefore, the rotational speed of the blank 7 returns to the target rotational speed NB at time-d where the teeth are fitted to be a nearly steady state with the sizing operation progressing.

In this example, since the hot rough-rolling step is terminated at time-e, the roughing roller dies 32,42 are withdrawn from the rolled gear 78 at time-e. Also, at time-e, the controller system 9 controls the transmitting torque variable clutch 26 in such a manner that the transmitting horsepower efficiency is returned to 100%; hence, the rotational speed of the blank 7 (i.e., the rolled gear 78) is kept at the target rotational speed $N_B$.

Also, the finishing roller dies 33,43 begin to engage with the rolled gear 78 at time-f. The rotational speed of the blank 7 (i.e., the rough-rolled gear 78) is kept at the target rotational speed $N_B$. Besides, as mentioned above, because of the key 34*m* and the keyways 32*i*,33*i*,38*i*, the forming teeth 32*c* of the first roughing rolled die 32 and the forming teeth 33*c* of the first finishing roller die 33 agree with each other in the circumferential phase. Similarly, the teeth 42*c* of the second roughing rolled die 42 and the forming teeth 43*o* of the second finishing roller die 43 agree with in the circumferential phase. Further, the roller die 32, 33,42,43 are controlled to be rotated usually at the constant rotational speed $N_R$ on the basis of the controller system 9.

In this embodiment including the aforementioned construction, when the finish-rolling step is started, the relationship which exists between the teeth 78*c* of the rough-rolled gear 78 and the forming teeth of the roughing roller die 32 and which exists immediately after the termination of the hot rough-rolling step, is stably kept not to vary. Therefore, the teeth 33*c*, 43*c* of the finishing roller dies 33,43 can be smoothly engaged with the teeth 78*c* of the rolled gear 78.

This matter will be hereinafter described in detail on the basis of FIGS. 7(A), 7(B) and 7(C). Time-e is immediately after the termination of the hot rough-rolling step. The rough-rolled gear 78 is rotated at the target rotational speed $N_B$ at time-e. In this circumstances, as can be understood from FIG. 7(A), the forming teeth 42*c* of the roughing roller die 42, rotating at the rotational speed $N_R$, are transferred in the direction of the arrow "X2" to be withdrawn from the teeth 78*c* of the rolled gear 78 after the termination of the hot rough-rolling step.

For the purpose of starting the finish-rolling, as can be seen in FIG. 7(B) showing the state in time-f, since the finishing roller die 43 rotating at the rotational speed $N_R$ is squeezed in the direction of the arrow "X1", the forming teeth 43*c* of the finishing roller die 43 can begin to engage with the teeth 78*c* of the rough-rolled gear 78 smoothly. This reason is explained as follows: since the forming teeth 43*c* of the finishing roller die 43 and the teeth 42*c* of the rough-rolling die 42 agree with each other in the circumferential phase, and since the finishing roller die 43 rotates at the constant speed $N_R$, the relationship between the teeth 78*c* of the rough-rolled gear 78. and the forming teeth immediately after termination of the hot rough-rolling step is stably kept not to vary.

Therefore, this embodiment is advantageous in improving finished accuracy and producing efficiency in the finish-rolling step.

FIG. 7(C) shows time-f where the conventional engagement starts. At time-f shown in FIG. 7(C), the rotational speed of the rolled gear 78 varies to $(N_B+\alpha)$, the relationship immediately after the termination of the rough-rolling step can not be kept to be varied. So, the teeth 78*c* of the rolled gear 78 and the forming teeth 43*c* of the finishing roller die 43 collide with each other at the starting of engagement, and thereby the smooth engagement is hindered.

FIG. 6 shows an engaging early-region being after the start of engagement in the finish-rolling step, namely, a region from time-g through time-h, as$\Delta$T2. In this engaging early-region of the finish-rolling, the transmitting torque variable clutch 26 is controlled to reduce the ratio of the transmitting horsepower on the basis of the controller system 9. As a result, the rolled gear 78 is driven owing to the finishing roller dies 33,43.

On condition that the rolled gear 78 is driven in this way, even if the phase-difference exists slightly between the roughing roller dies 32,42 and the finishing roller dies 33,43, the phase-difference is corrected to be canceled. Thus, the compression to the teeth surface constituting the teeth 78*c* of the rolled gear 78 is easy to be uniform.

In the case where time-h is progressed, the rolled gear 78 is again rotated at the target rotational speed $N_B$. The finish-rolling step is terminated at time-i.

(Roller Die 38,48 for carrying out Another Treatment such as Chamfering or Marking)

In accordance with this embodiment, the target is the keeping of the phase-relationship which exists between the teeth 78*c* of the rolled gear 78 and the forming teeth 33*c*,43*c* of the finishing rolled dies 33, 43 in the circumferential phase and which exists immediately after the termination of the finish-rolling step. On the basis of this target, since the controller system 9 controls the finishing roller dies 33,43, the roller dies 38,48 for chamfering or marking and the rolled gear 78 in order to rotate them. In this circumstances, the roller squeezing apparatus 31, 41 are squeezed toward the rolled gear 78 to engage the forming teeth 33*c*,43*c* of the finishing roller dies 33,43 with the teeth of the rolled gear 78 smoothly.

(Blank Holding Mechanism)

Figure 8:
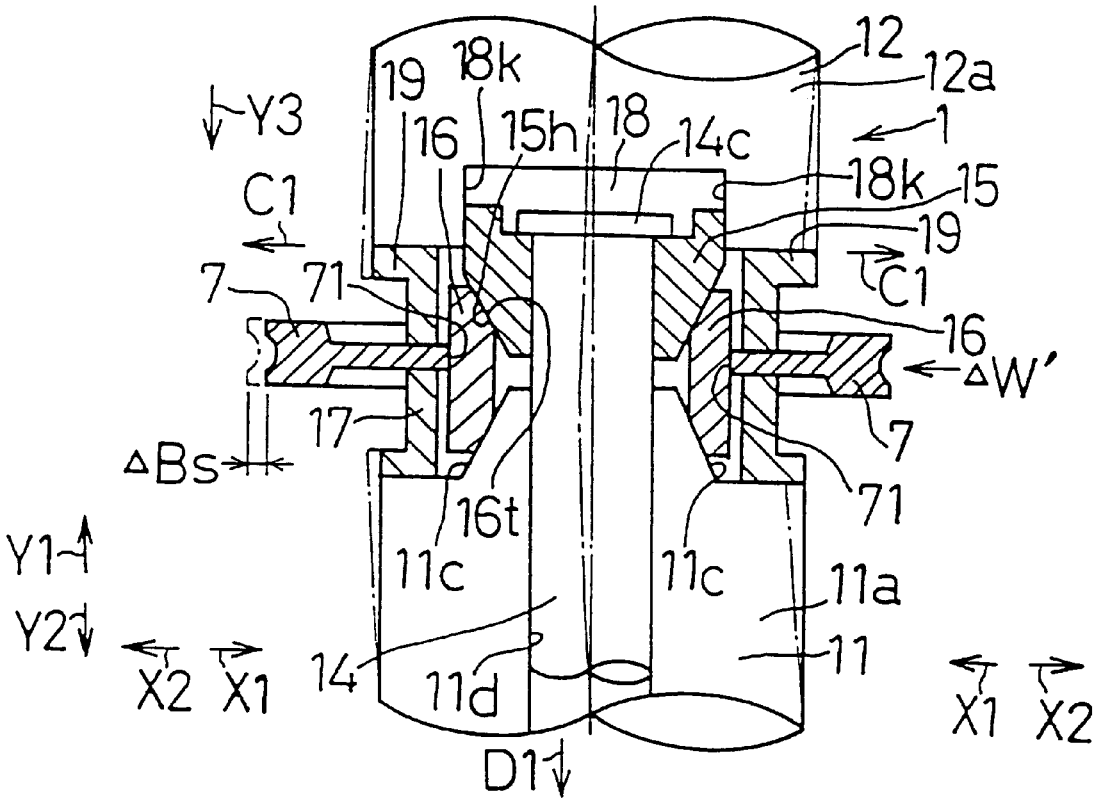
FIG. 8 is a constructive view which illustrates a construction of a blank holding portion.

Now, the holding mechanism of the blank holding portion 1 will be described hereinafter. As shown in FIG. 8, the first blank holding portion 11 includes a first holding shaft 11*a*, a operating shaft 14, a tightening body 15 having a sleeve-shape, a collet 16, a pressing body 17 having a ring-shape. The first holding shaft 11*a*, having high rigidity, includes a first conical surface 11*c* having a reducing outer diameter as it goes to an axial end. The operating shaft 14 is slidablely inserted in an inserting hole 11*d* of the first holding shaft 11*a*. The tightening body 15 is disposed at the end of the first holding shaft 11*a* to be engaged with a flange 14*c* positioned at the axial end of the operating shaft 14. The collet 16 operates as a engaging claw capable of moving in the direction of the arrow "C1", namely, the radius outward direction. The pressing body 17 is held at the end surface of the first holding shaft 11*a* by use of bolts(not shown).

In FIG. 8, when the operating shaft 14 is operated in the direction of the arrow "D1", the tightening body 15 is moved in the same direction. Thus, a conical surface 15*h* of the tightening body 15 pushes a conical surface 16*t* of the collet 16 forcibly. As a result, the collet 16 is moved in the direction of the arrow "C1", and the collet 16 urges the inner wall surface 71 constituting the hole of the blank 7 in the direction of the arrow "C1", and thereby the blank 7 is firmly held by use of the first blank holding portion 11.

The second blank holding portion 12 comprises an inserting bore 18 formed at the axial end thereof and a ring-shaped pressing body 19 held with bolts (not shown) at the axial end. A guiding wall surface 18*k* with a slight inclination is formed at the inner surface of the inserting bore 18.

When the first blank holding portion 11 and the second second blank holding portion approach each other relatively along the axial direction, as can be understood in FIG. 8, the inserting bore 18 of the second holding shaft 12*a* of the second blank holding portion 12 is forcibly inserted into the tightening body 15. Accordingly, the tightening body 15 is restricted in the radius direction. Thus, the force for restricting the blank 7 becomes high rigidity, and the first blank holding portion 11 and the second holding portion 12 hold the blank 7 securely. Therefore, the blank 7, which is held by use of the the first blank holding portion 11 and the second holding portion 12, can not fluctuate substantially in the directions of the arrow "X1,X2". So, this embodiment employs a non-flowing method which is sometimes called as a locking method.

(Characteristic Value of the Apparatus)

According to the apparatus in this embodiment, since characteristic values are set as follows: This apparatus has effect in which the accuracy of the rolled gear is more improved.

[Blank Holding Rigidity]

In this embodiment, the blank holding rigidity is set more rigid than 0.1 mm/tonf in the direction of the arrow "X1", namely, the squeezing direction. Concretely, from 0.01 through 0.085 mm/tonf, or from 0.07 through 0.08 mm/tonf.

The aforementioned blank holding rigidity on the basis of the blank holding portion 1 is defined as follows:

As shown as an imaginary line in FIG. 8, it is supposed that the first holding shaft 11*a* and the second holding shaft 12*a* are bent due to umbalanced force $\Delta W'$ to generate the deflection $\Delta Bs$ of the blank 7 in the directions of the arrow "X1,X2", that is, the squeezing direction. For comprehension of them, the imaginary line draws the deflection exaggeratingly.

In the case where the blank holding rigidity is indicated as $E_B$, $E_B$ is concluded as follows:

$$EB=\{\gamma B_S\ (mm)/\Delta W'(tonf)\}$$

In order that the blank holding rigidity $E_B$ is more rigid than 0.1 mm/tonf, the following (A)(B) are required.

(A) A rickety movement, existing between the outer wall surface of the collet 16 and the inner wall surface 71 of the blank 7, is to become infinitesimal or a zero;

(B) The rigidity of the first holding shaft 11*a* of the first blank holding portion 11 and the second holding shaft 12*a* of the second blank holding portion 12 is more rigid in the squeezing direction (i.e., the directions of the arrow "X1, X2).

For realizing the abovementioned (A)(B), the following (a) through (e) are important.

(a) Increasing the diameter of the first holding shaft 11*a* and the second holding shaft 12*a;*

(b) Thickening the first housing 36 and the second housing 46;

(c) Increasing the number of reinforcing ribs for enlarging the rigidity of the housing 36,46;

(d) Selecting the material having high-rigidity as a base metal;

(e) Setting the rickety movement of the sliding surface for transferring the housing 36,46 to a zero by way of a locking mechanism such as a hydraulic pressure mechanism.

[Squeezing Synchronous Precision]

The squeezing synchronous precision means an average deflection in a squeezed amount of the first roller die 32 and the second roller die 42 during the rolling step when both of the roller dies are synchronously squeezed with respect to the blank 7.

In this embodiment, the squeezing synchronous precision L between the first roller die 32 and the second roller die 42 is set higher than 0.03 mm in the direction of the arrow "X1", namely, the squeezing direction. Concretely, it is set in the range from 0.005 through 0.03 mm. In this embodiment, not only the squeezing synchronous precision between the first roughing roller die 32 and the second roughing roller die 42, but also the squeezing synchronous precision between the first finishing roller die 33 and the second finishing roller die 43, the squeezing synchronous precision is the aforementioned same range.

The squeezing synchronous precision is expressed as follows: In FIG. 2, when the distance between the outer end of the first roller die 32 for contacting the blank 7 and the central axial line of the blank holding portion 1 is indicated as $L_{LS}$ (mm). And the distance between the outer end of the second roller die 42 for contacting the blank 7 and the central axial line of the blank holding portion 1 is indicated as $L_{RS}$ (mm). The affixed "S" in "$L_{LS}$" and "$L_R$" means the outer end of the roller die.

In the case where a squeezing synchronous precision as a moment value at a certain time is indicated as ΔL', ΔL' means an absolute value of the difference between the a squeezed amount of the first roller die 32 and a squeezed amount of the second roller die 42 at the certain time.

In other words, $\Delta L' = |L_{LS} - L_{RS}|$

As the aforementioed ΔL' is a moment value, it varies from the starting to the terminating in the rolling step; therefore, the average value of the aforementioned moment values ΔL' is determined as the squeezing synchronous precision ΔL in the present invention.

The aforementioned ΔL' is under the influence of the originally feeding precision on the basis of the roller squeezing apparatus 3 in the no-load condition and a bending amount of the roller squeezing apparatus 3 during the rolling step.

In order to improve the squeezing synchronous precision ΔL for obtaining high-rigidity like this embodiment, it is thought that an oil system using oil pressure is insufficiency. Because the feeding precision in not enough.

The aforementioned squeezing synchronous precision having high precision is achieved as follows: As shown in FIG. 1, the ball-screw system having the accurate ball screw shafts 37, 47 is employed, and the servo-controlled system operating the ball screw shafts 37,47 synchronously by way of the motors 24,25 operating as servo-motor is employed. A combination of these systems shows that the feeding precision for transferring the first roller die 32 and the second roller die 42 in the squeezing direction is improved to be high, and the rigidity of the roller squeezing apparatus 3 is high.

[Rigidity of the Roller Squeezing Apparatus]

Figure 9:
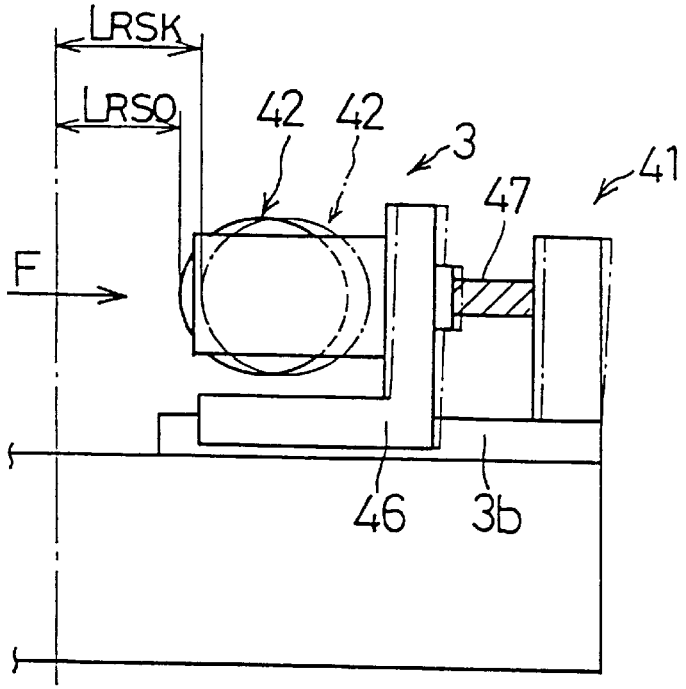
FIG. 9 is a constructive view which explains rigidity in a squeezing direction of the roller squeezing apparatus.

In this embodiment, the rigidity of the roller squeezing apparatus 3 is set in the region more rigid than 0.01 mm/tonf. Concretely, it is set to be in the range of from 0.033 through 0.01 mm/tonf. The rigidity of the roller squeezing apparatus 3 is defined as follows: As shown in FIG. 9, $L_{RSO}$ (mm) indicates the distance from the central axial line of the blank holding portion 1 to the outer end of the roller die 42 under no-load. On the other hand, when load "F" applied to this apparatus, $L_{RSK}$ (mm) indicates the distance the central line of the blank holding portion 1 to the outer end of the roller die 42.

Here, the rigidity of the roller squeezing apparatus 3 is indicated as $E_R$, $E_R(\text{mm/tonf}) = \{(L_{RSK} - L_{SRO})/F\}$ In FIG. 9, the deflection is exaggeratingly drawn by use of the imaginary line for comprehension.

[Phase-Difference between Dies during Rolling]

In this embodiment, the phase-difference between the first roller die 32 and the second roller die 42 is controlled on the basis of the controller system 9. Therefore, the deflection (=an average deflection during rolling), existing between the rotating angle of the second roller die 42 and the rotating angle of the first roller die 32 with respect to one rotation of the first roller die 32, is suppressed within 0.1°. This deflection is preferably within 0.03°. On condition that the motor 5 constituting the servo-motor for rotating the die is controlled by use of the controller system 9, the phase adjusting mechanism 55*x* is employed and the constant speed universal joints 53,5 are employed, this small phase-difference can be advantageously realized.

Figure 10:
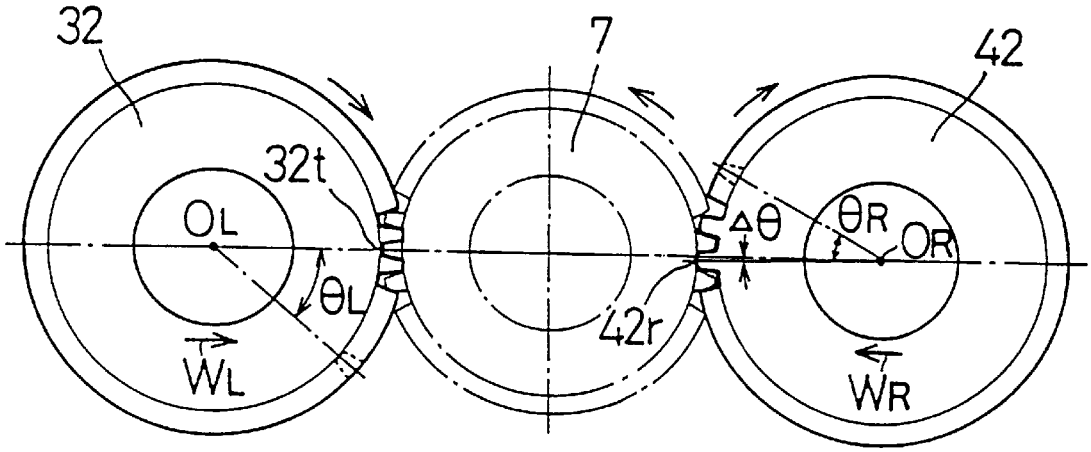
FIG. 10 is a constructive view which illustrates a phase-difference of the roller dies.
Figure 11:
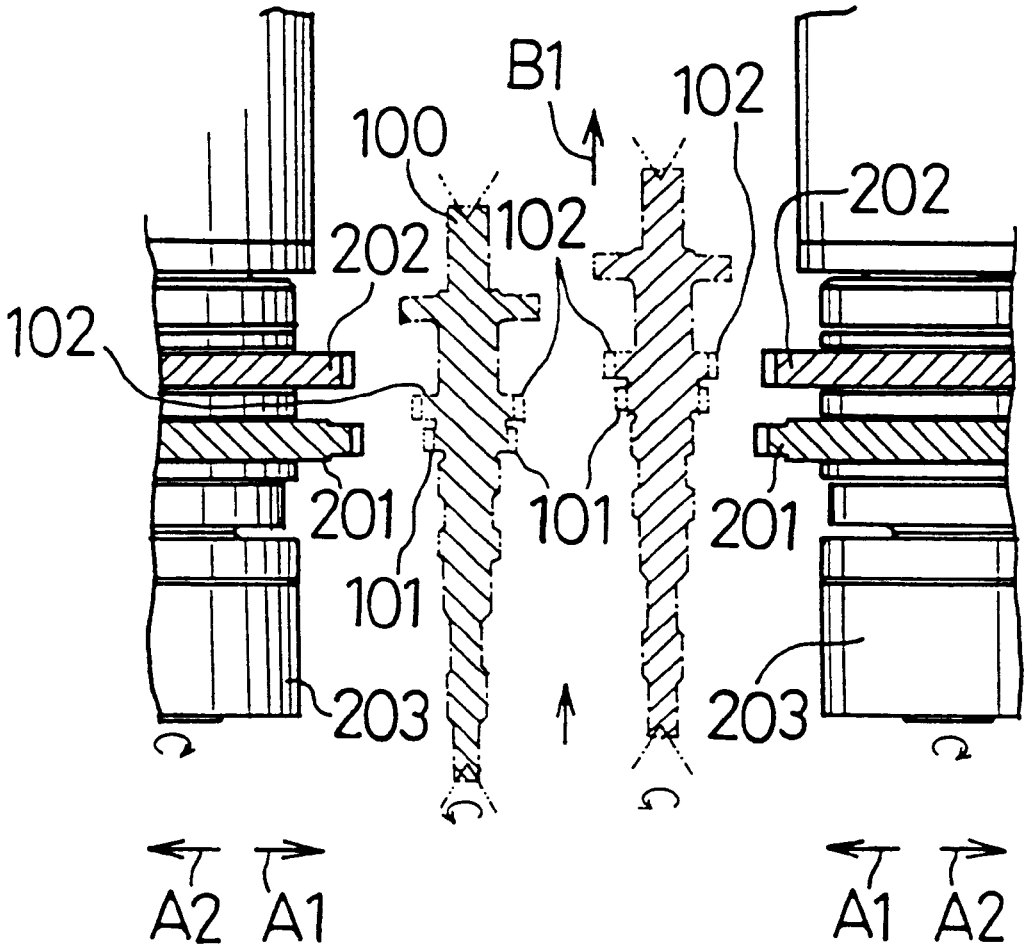
FIG. 11 is a constructive view which illustrates the conventional apparatus disclosed in Japanese Unexamined Patent (KOKAI) No.54-62,148.

Taking that the number of the teeth of the rolled gear is an odd number as an example, the phase-difference of the dies will be hereinafter explained. As shown in FIG. 10, "$O_L$" indicates the central line of the first roller die 32, on the other hand, "$O_R$" indicates the central line of the second roller die 42. The "$O_L$-$O_R$" line connects both of the central lines.

When one of the teeth-groove centers 32*t* in the first roller die 32 is always disposed on the "$O_L$-$O_R$" line during rolling, and when one of centers 42*r* of the forming teeth in the second roller die 42 is always disposed on the "$O_L$-$O_R$" line during rolling, the difference between both the dies comes to be 0°.

Here, the phase-difference between both the dies during rolling is under influence of the sum adding an initial phase-difference Δθ to a speed dispersion Δθ m in the rotating mechanism. The initial phase-difference Δθ, existing between the first roller die 32 and the second roller die 42, will be hereinafter described as follows: It is requested before rolling that the center 32*t*,42*r* in the roller die 32,42 must be disposed on the "$O_L$-$O_R$" line. In spite of this request, when the center 42*r* of forming teeth in the second roller die 42 is shifted by Δθ with respect to the "$O_L$-$O_R$" line before rolling, the angle Δθ is defined as the initial phase-difference between the first roller die 32 and the second roller die 42.

Moreover, when the first roller die 32 is rotated by rotational angle $\theta_L$, it is ideally requested that the rotational angle $\theta_R$ of the second roller die 42 is equal to $\theta_L$.

However, $\theta_R$ is not equal to $\theta_L$ in a microscopic level. Because of the influence of rotational dispersion of the rotational mechanism.

Thus, generally, $\theta_R = \theta_L + \Delta\theta\ m'$

Here, Δθ' m is defined as an speed dispersion in the rotational mechanism. Δθ' m is a moment value at a certain time, and varies slightly during rotating. So, in this embodiment, not a moment value but an average value from the starting of the rolling to the terminating of the rolling is defined as the aforementioned $\Delta\theta$ m.

In the case where the number of the teeth of the rolled gear is an even number, one of the teeth-groove of the forming teeth of the first roller die 32 is disposed to face with one of the teeth-groove of the forming teeth of the second roller die 42. In such circumstances, when one of the teeth-groove centers of the first roller die 32 and one of centers of the teeth-groove of the second roller die 42 are disposed on the "$O_L$-$O_R$" line, the phase-difference comes to be 0°.

[Experiment]

In an experiment, a module of the target gear was set at 2.4, a helix angle was set at 30°, the number of the teeth was set at 67, a facewidth of the teeth was set at 21 mm, the number of the roller dies 32, 42, 33, 43 was set at 73, a rotational speed of each roller dies 32, 42, 33, and 43 was set at 300 rpm.

In this experiment, the induction heating was curried out on condition of 3 kHz, 600 kW. During rolling, liquid lubricant, diluting a graphite based lubricant with water, was sprayed at the rate of 5 cc/sec.

Accuracy of the rolled gears generated on the basis of the aforementioned steps is measured. The rolled gears, having the good accuracy in the range of from class 3 through class 4 in JIS-STANDARD, were produced in the case where the hot roughing-rolling step was carried out by use of the first roughing roller die 32 and the second roughing roller die 42 without the warm finish-rolling step.

Moreover, after 3 seconds from the hot rough-rolling step, the warm rough-rolling step was carried out for 5 seconds on condition that a compressed amount of the teeth-surface was set at 30 micrometers and the temperature was set in the range of from 500 through 600° C.; hence, the rolled gears which have class 2 through class 3 in JIS-STANDARD and which can not be produced in the conventional gear-rolling technique, were produced.

(Other Embodiment)

In the aforementioned embodiment, both of the first roller squeezing apparatus 31 and the second roller squeezing apparatus 41 are used. However, either the first roller squeezing apparatus 31 or the second roller squeezing apparatus 41 may be used on condition that the blank holding rigidity is high.

What is claimed is:

1. A multistage gear-rolling apparatus comprising:

a workpiece holding portion for holding a workpiece to be transformed into a rough-rolled gear;

a motor for rotating said workpiece holding portion with said workpiece;

a clutch disposed between said motor and said workpiece holding portion, said clutch capable of varying a transmitting ratio between said motor and said workpiece holding portion;

a first roller squeezing apparatus capable of squeezing said workpiece and withdrawing from said workpiece, said roller squeezing apparatus including at least a first roughing roller die and a first finishing roller die disposed coaxially and connected in series in an axial direction of said roughing roller die, said roughing roller die having a plurality of forming teeth arranged in a circumferential direction for a rough-rolling step, said finishing roller die having a plurality of forming teeth arranged in a circumferential direction for a finish-rolling step;

a second roller squeezing apparatus facing said first roller squeezing apparatus, said second roller squeezing apparatus capable of squeezing said workpiece and withdrawing from said workpiece, and second roller squeezing apparatus having at least a second roughing roller die and a second finishing roller die disposed coaxially and connected in series in an axial direction of said second roughing roller die, said second roller squeezing apparatus being movable independent of said first roller squeezing apparatus;

means for adjusting a phase of said forming teeth of said first roughing roller die and a phase of said forming teeth of said first finishing roller die to each other in a circumferential direction; and engagement controlling means for controlling said engagement between said forming teeth of said first finishing roller die and the teeth of said rough-rolled gear in a circumferential direction, said engagement controlling means maintaining a circumferential phase-relationship between said teeth of said rough-rolled gear formed by said first and second roughing roller dies and said forming teeth of said first and second roughing roller dies, said engagement controlling means rotates said first roughing roller die, said first finishing roller die, said second roughing roller die, said second finishing roller die and said workpiece held on said workpiece holding portion, squeezes said first and second roller squeezing apparatuses to said rough-rolled gear with said phase-relationship immediately after said rough-rolling step, and said forming teeth of said first and second finishing roller dies are smoothly engaged with said teeth of said rough-rolled gear;

wherein said first roller squeezing apparatus and said second roller squeezing apparatus are driven synchronously in a radial direction with respect to one another.

2. A multistage gear-rolling apparatus according to claim 1, wherein said engagement controlling means controls said transmitting ratio of said clutch so that said workpiece rotates at the starting of the engagement between said finishing roller die and rough-rolled gear at a uniform speed which is equal to a speed at the terminating of the rough-rolling step.

3. A multistage gear-rolling apparatus according to claim 2, wherein said engagement controlling means decreases said transmitting ratio of said clutch in order for said workpiece to rotate at a uniform speed as a target in an early period of the rough-rolling step for preventing the workpiece-speed increasing so that said workpiece rotates at a uniform speed.

4. A multistage gear-rolling apparatus according to claim 2, wherein said engagement controlling means descreses said transmitting ratio of said clutch as a target so that said workpiece is driven with said finishing roller die in an early period of a finish-rolling step for canceling a phase difference between said roughing roller die and said finishing roller die.

5. A multistage gear-rolling apparatus according to claim 1, wherein said first and second roughing roller dies are used for carrying out a hot rough-rolling step, and said first and second finishing roller dies are used for a warm finish-rolling step.

6. A multistage gear-rolling apparatus according to claim 1, the workpiece holding rigidity of said workpiece holding portion is set more rigid than 0.1 mm/tonf in the squeezing direction.

7. A multistage gear-rolling apparatus according to claim 1, wherein the workpiece holding rigidity of said workpiece holding portion is in the range of from 0.01 mm/tonf through 0.085 mm/tonf in the squeezing direction.

8. A multistage gear-rolling apparatus according to claim 1, wherein a squeezing synchronous precision between said first roller squeezing apparatus and said second roller squeezing apparatus is set in the range of 0.005 mm through 0.03 mm.

9. A multistage gear-rolling apparatus according to claim 1, wherein a phase-difference between said first roughing roller die and said second roughing roller die in the circumferential direction is set within 0.1°, and a phase-difference between said first finishing roller die and said second finishing roller die in the circumferential direction is set within 0.1°.

10. The multistage gear-rolling of claim 1, wherein the workpiece holder comprises:

a first workpiece holding portion; and a second workpiece holding portion;

wherein the first and second workpiece holding portions are movable for positioning the workpiece in substantial alignment with one of the roughing roller die and the finishing roller die.

11. A multistage gear-rolling apparatus according to claim 1, further comprising:

first moving means for moving the first movable roller squeezing apparatus; and second moving means for moving said second movable roller squeezing apparatus, said first moving means and said second moving means squeezing and withdrawing said first movable roller squeezing apparatus and said second movable roller squeezing apparatus, respectively, with respect to one another.

12. A multistage gear-rolling apparatus according to claim 1, wherein said first roller squeezing apparatus has a first ball screw shaft and a motor for rotating said first ball screw shaft for squeezing said workpiece and withdrawing from said workpiece;

said second roller squeezing apparatus has a second ball screw shaft and another motor for rotating said second ball screw shaft for squeezing said workpiece and withdrawing from said workpiece.

* * * * *